US006077239A

United States Patent [19]

Lin

[11] Patent Number: 6,077,239

[45] Date of Patent: Jun. 20, 2000

[54] RUBBING PLATE

[76] Inventor: Jung-Miin Lin, 9F-2, No. 341, Sec.4, Chung Hsiao East Rd., Taipei, Taiwan

[21] Appl. No.: 09/134,902

[22] Filed: Aug. 17, 1998

[30] Foreign Application Priority Data

Aug. 19, 1997 [TW] Taiwan ..... 86214072

[51] Int. Cl.[7] ..... A61H 37/00

[52] U.S. Cl. ..... 601/137; 601/134; 601/135; 601/136

[58] Field of Search ..... 601/137, 133, 601/134, 135, 136, 138; 482/49, 44; D21/684, 104; 606/204, 204.35; 15/245, 121; 33/561.1, 562.2, 27.1, 27.01; 273/153 R; 132/107, 219; 446/268; D24/211, 212

[56] References Cited

U.S. PATENT DOCUMENTS

| | | | |
|---|---|---|---|
| D. 304,748 | 11/1989 | Bowers | D21/684 |
| 3,129,939 | 4/1964 | Stock | 482/49 |
| 3,557,776 | 1/1971 | Boots | 482/49 |
| 4,590,926 | 5/1986 | Courtin | 601/137 |
| 5,285,774 | 2/1994 | Stachurski | 601/135 |
| 5,382,222 | 1/1995 | Yih-Jong | 601/135 |
| 5,454,132 | 10/1995 | Neves | 15/105 |
| 5,492,525 | 2/1996 | Gibney | 601/40 |
| 5,624,385 | 4/1997 | Hwang | 601/135 |
| 5,843,005 | 12/1998 | Chubinsky | 601/15 |
| 5,863,251 | 1/1999 | Fusco | 482/108 |

*Primary Examiner*—Richard J. Apley
*Assistant Examiner*—Justine R. Yu
*Attorney, Agent, or Firm*—Bacon & Thomas, Pllc

[57] ABSTRACT

A rubbing plate of flat, elongated shape having a plurality of recessed portions and flat peripheral edges at the peripheral sides thereof and massaging area formed of raised portions at the outside wall for massing the head, the palms, the neck, orbital region, the fingers and acupuncture points of the body. The recessed portions preferably have different curvatures and lengths.

7 Claims, 5 Drawing Sheets

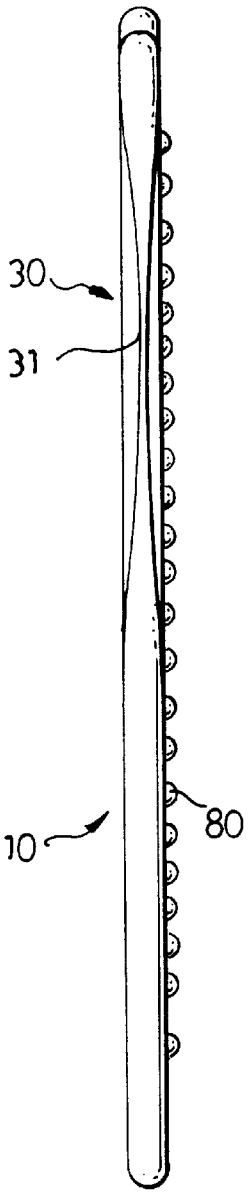
FIG. 2
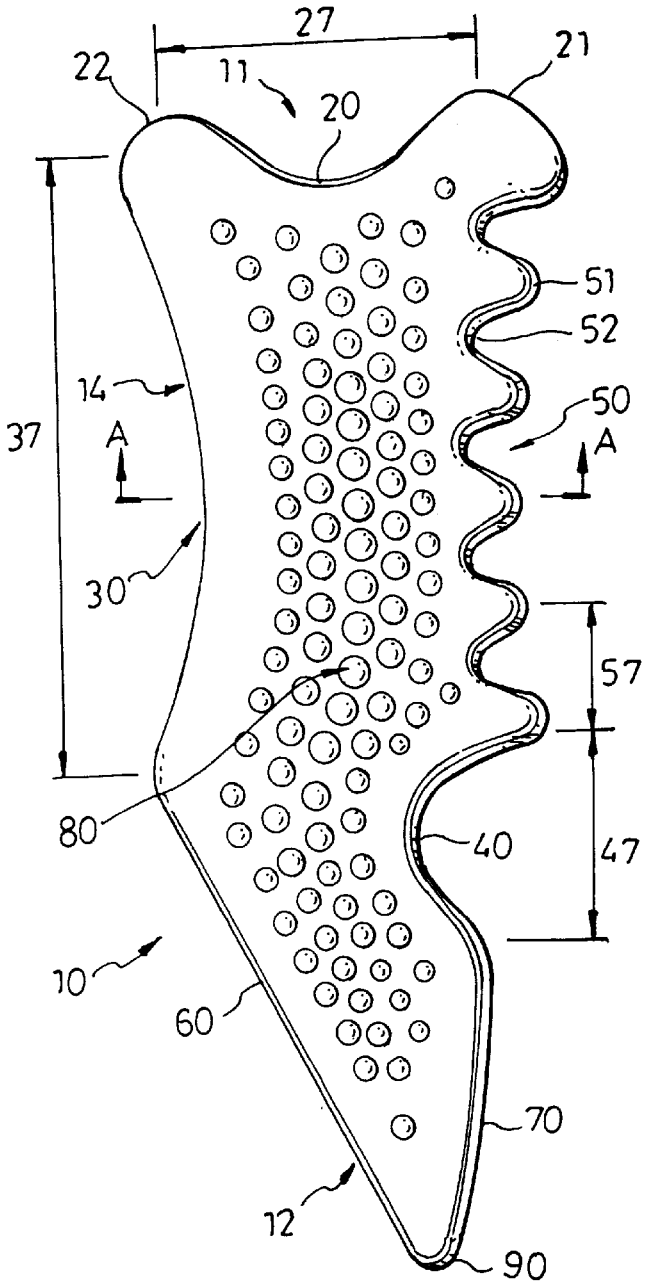
FIG. 1
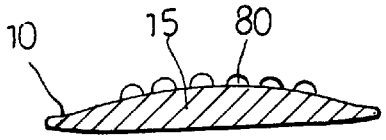
FIG. 3
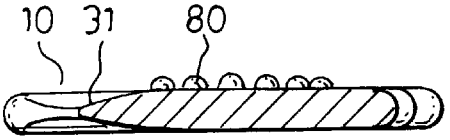
FIG. 1-A

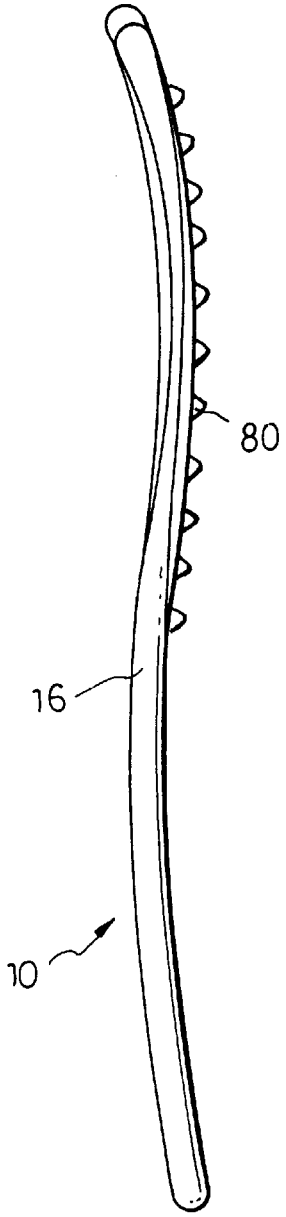
FIG.7
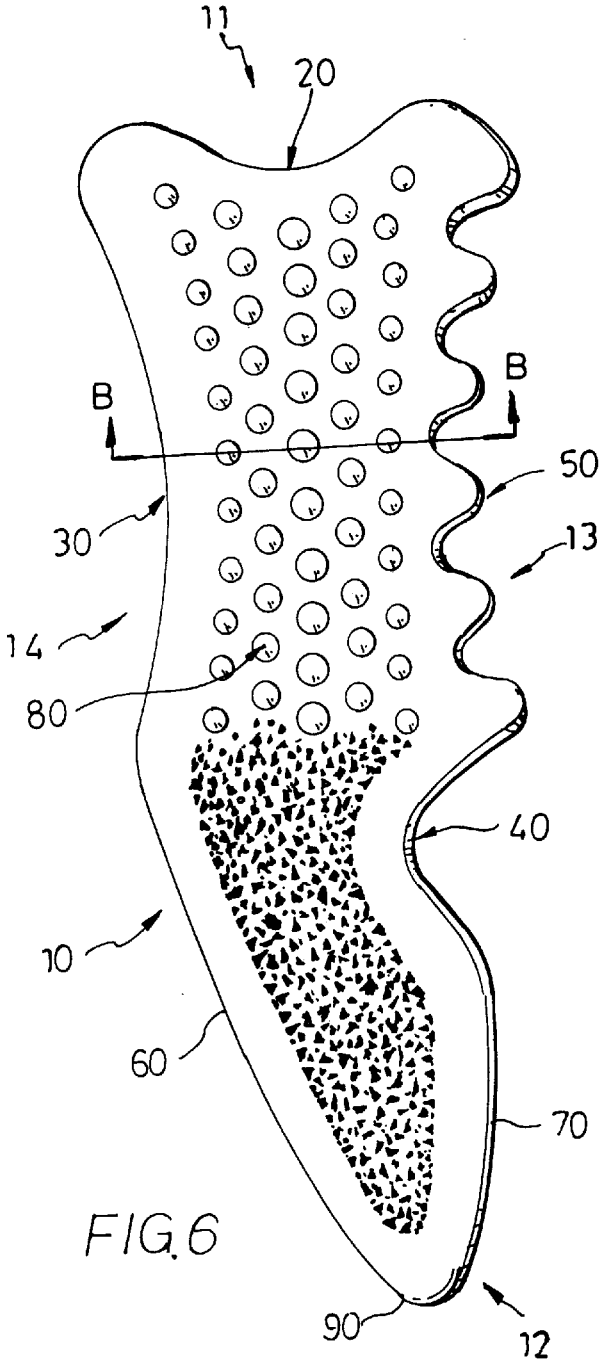
FIG.6
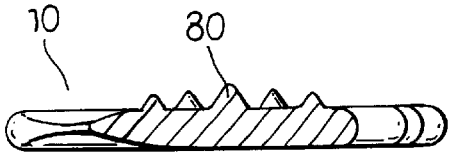
FIG.6-B

RUBBING PLATE

BACKGROUND OF THE INVENTION

The present invention relates to a rubbing plate for rubbing the body to stimulate the circulation of blood.

A rubbing plate is a massaging device commonly used in Chinese speaking countries or areas for rubbing a particular area of the body to stimulate the circulation of blood. Unlike the complicated application of acupuncture and moxibustion, special techniques are not needed to use a rubbing plate. A regular rubbing plate is a flat plate having a few irregularly curved peripheral edges for rubbing the body. Only a few rubbing plates have a different shape from that of conventional rubbing plates, such as disclosed by Taiwanese Patent Publication No. 283941. However, these known rubbing plates are not practical for rubbing particular areas such as the head, the palm or the fingers.

SUMMARY OF THE INVENTION

It is the main object of the present invention to provide a rubbing plate which is practical for rubbing the head, the palm, the neck, the orbital region, the fingers, or any part of the body to stimulate the circulation of blood.

It is another object of the present invention to provide a rubbing plate which is handy.

It is still another object of the present invention to provide a rubbing plate which is orthopedically engineered and convenient for applying a rubbing force to a particular part of the body.

According to the invention, the rubbing plate has a flat, elongated shape, a first recessed portion and two convex portions at two opposite sides of the first recessed portion for rubbing the orbital region, a second recessed portion, a third recessed portion, a first flat peripheral edge, a second flat peripheral edge and a rear projecting portion for rubbing different areas of the body, and a convex-concave peripheral edge formed of a plurality of convex portions and concave portions alternatively arranged in a line for rubbing the head. Furthermore, a massaging area is provided at the outside wall and formed of a plurality of raised portions for massaging the palm and the skin. The rubbing plate can be made from any of a variety of materials, for example, the rubbing plate can be made from ceramics treated with infrared rays.

BRIEF DESCRIPTION OF THE DRAWINGS

FIG. 1 is a front view of a rubbing plate according to a first embodiment of the present invention.

FIG. 1A is a sectional view taken along line A—A of FIG. 1.

FIG. 2 is a side view of the rubbing plate shown in FIG. 1.

FIG. 3 is a sectional view of a rubbing plate according to a second embodiment of the present invention.

FIG. 6A is a front view of a rubbing plate according to a third embodiment of the present invention.

FIG. 6B is a sectional view taken along line B—B of FIG. 6.

FIG. 7 is a side view of the rubbing plate shown in FIG. 6.

DETAILED DESCRIPTION OF THE PREFERRED EMBODIMENT

Figure 4:
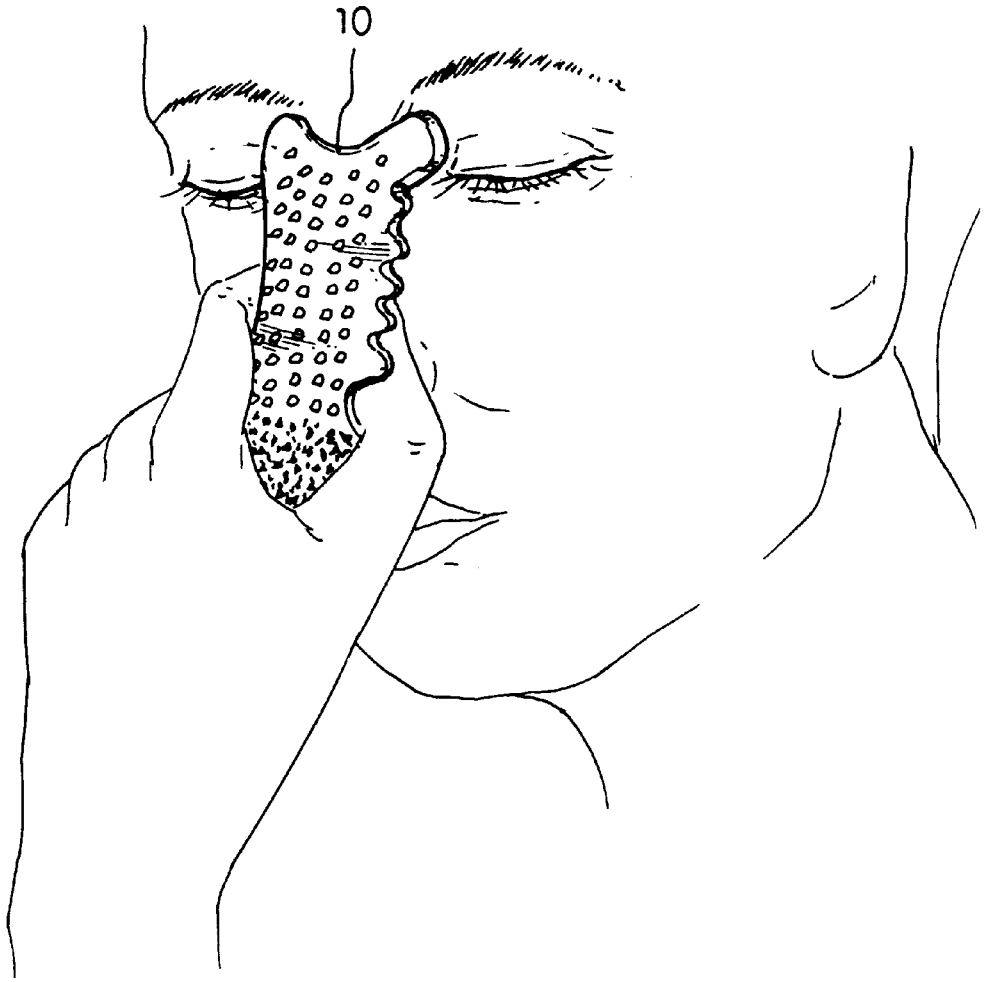
FIG. 4 is an applied view of the present invention, showing the rubbing plate rubbed against the orbital region.
Figure 5:
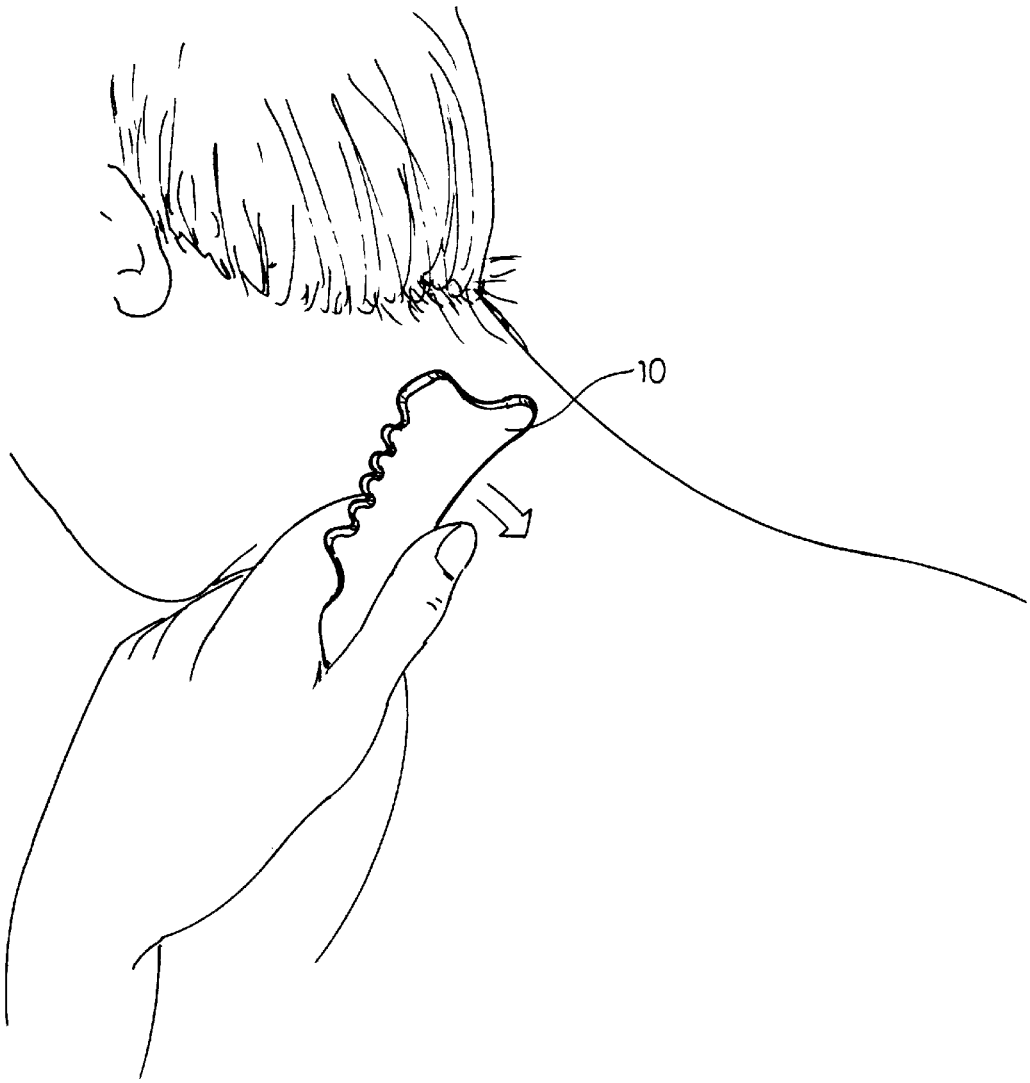
FIG. 5 is another applied view of the present invention, showing the rubbing plate rubbed against the back of the neck.

Referring to FIGS. 1, 1A and 2, a rubbing plate 10 is shown having an elongated, flat shape, a first recessed portion 20 smoothly curved inwards at the front side thereof, a first front convex portion 21 and a second front convex portion 22 raised from the front side and spaced by the first recessed portion 20. The first recessed portion 20 preferably has a length 27 of about 3 cm~7 cm. The first front convex portion 21 and the second front convex portion 22 are designed for rubbing the orbital region (see FIG. 4). The first recessed portion 20 is designed for rubbing the arms, the fingers, or any curved part of the body. At the first lateral side 13 of the rubbing plate 10, there is provided a convex-concave peripheral edge 50 formed of a plurality of convex portions 51 and recessed portions 52 alternatively arranged in a line. The distance 57 between each two adjacent convex portions 51 is preferably about 0.5 cm~3 cm. The corrugated peripheral edge 50 is designed for rubbing the head. The convex-concave peripheral edge 50 can have a corrugated or serrated shape, or any of a variety of irregular shapes with the convex portions 51 for rubbing the head. At the second lateral side 14, there is provided a second recessed portion 30 smoothly curved inwards. The length 37 of the second recessed portion 30 is greater than that of the length 27 of the first recessed portion 20, and designed for rubbing for the neck (see FIG. 5), the arms, the legs, etc. The second recessed portion 30 has a thin area 31 that is convenient for rubbing the body.

There is also provided a third recessed portion 40 smoothly curved inwards at the first lateral side 13 of the rubbing plate 10 for rubbing the fingers or the toes. The length 47 of the third recessed portion 40 is smaller than the distance 27 of the first recessed portion 20.

A first flat peripheral edge 60 and a second flat peripheral edge 70 are respectively provided at the second lateral side 14 and the first lateral side 13. The first flat peripheral edge 60 is suitable for rubbing the back. The second flat peripheral edge 70 is suitable for rubbing the inner side of the sole. At the rear side 12 of the rubbing plate 10, there is provided a rear projecting portion 90 for rubbing a particular small area for example an acupuncture point.

The rubbing plate 10 further comprises a massaging area 80 formed of a plurality of raised portions for massaging. In the first embodiment shown in FIG. 1A, the raised portions of the massaging area 80 are raised from a flat surface at the top side of the rubbing plate 10. In the second embodiment shown in FIG. 3, the raised portions of the massaging area 80 are raised from a convex surface 15 at the top side of the rubbing plate 10.

FIGS. 6A, 6B and 7 show a rubbing plate according to a third embodiment of the present invention. According to this embodiment, the rubbing plate 10 has a curved profile (see FIG. 7), i.e., the rubbing plate 10 has a curved top side and a curved bottom side, wherein the top and bottom sides being curved in opposite directions along the longitudinal axis of plate 10. This curved design is practical for use as a beater for beating the neck. The massaging area 80 is a non-flat surface area integral with the curved top side of the rubbing plate 10. The massaging area 80 is comprised having a plurality of raised portions of any of a variety of shapes and sizes.

Figure 8:
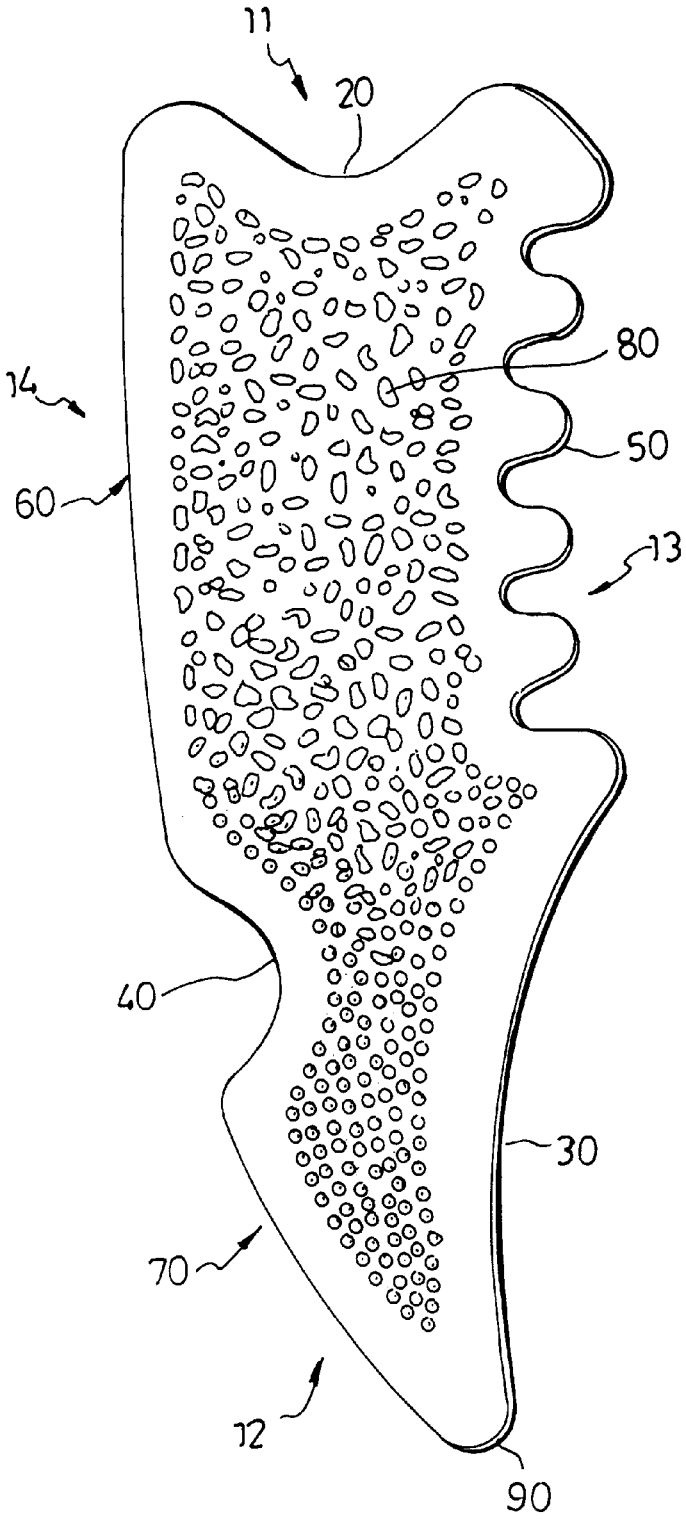
FIG. 8 is a front view of a rubbing plate according to a fourth embodiment of the present invention.
Figure 9:
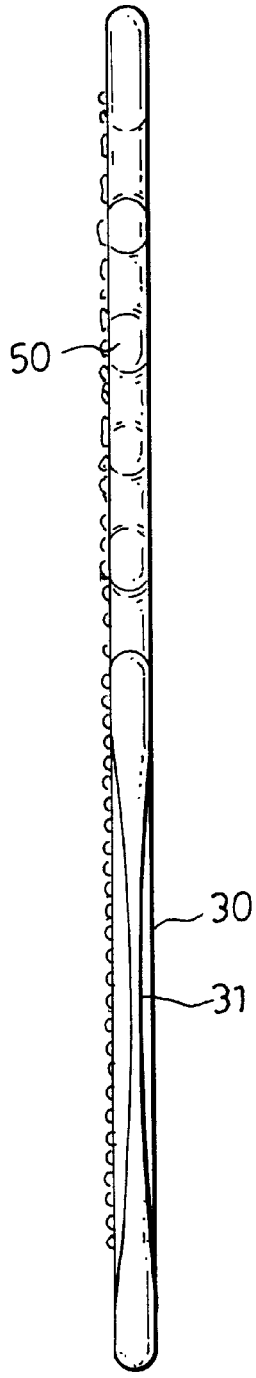
FIG. 9 is a side view of the rubbing plate shown in FIG. 8.

The locations of the second recessed portion 30, the third recessed portion 40, the first flat peripheral edge 60 and the second flat peripheral edge 70 can be changed subject to the desired design. In the fourth embodiment of the present invention as shown in FIGS. 8 and 9, the second recessed portion 30 is provided below the convex-concave peripheral edge 50, the first flat peripheral edge 60 is provided at the front area of the second lateral side 14, the third recessed portion 40 and the second flat peripheral edge 70 are provided behind the first flat peripheral edge 60, and the rear projecting portion 90 is disposed between the second recessed portion 30 and the second flat peripheral edge 70.

It is to be understood that the drawings are designed for purposes of illustration only, and are not intended as a definition of the limits and scope of the invention disclosed.

What the invention claimed is:

1. A rubbing plate of flat elongated shape comprising:

a) a front side, a rear side, a first lateral side, a second lateral side, a top side, a bottom side;

b) the front side including a first convex portion, a second convex portion, a first recessed portion disposed between the first and second convex portions, the length of the first recessed portion being within a range of about 3 to 7 cm; and c) the first lateral side including a plurality of alternating convex and recessed portions, the distance between each two adjacent convex portions being within a range of about 0.5 to 3 cm, and a second recessed portion having a length greater than the length of the first recessed portion.

2. The rubbing plate of claim 1 wherein the second recessed portion further includes a peripheral thinned portion.

3. The rubbing plate of claim 1 wherein the second lateral side includes a third recessed portion having a length that is less than the length of the first recessed portion.

4. The rubbing plate of claim 1 wherein the second lateral side includes a first flat peripheral edge.

5. The rubbing plate of claim 4, wherein the second lateral side further includes a second flat peripheral edge.

6. The rubbing plate of claim 1 wherein the rear side includes arear projecting portion.

7. The rubbing plate of claim 1 wherein at least one of the top and bottom sides includes a massaging area defined by a plurality of raised portions.

* * * * *